United States Patent [19]

Lindsay

[11] 3,963,171

[45] June 15, 1976

[54] CUSHION PARTITION TRAY FOR INSERTION INTO A BOX

[75] Inventor: La Vern G. Lindsay, Petersburg, Mich.

[73] Assignee: Union Camp Corporation, Wayne, N.J.

[22] Filed: July 29, 1975

[21] Appl. No.: 599,992

[52] U.S. Cl. ..... 229/42; 229/15

[51] Int. Cl.[2] ..... B65D 5/48

[58] Field of Search ..... 229/15, 27, 28, 42; 217/18, 19

[56] References Cited

UNITED STATES PATENTS

| | | | |
|---|---|---|---|
| 2,596,205 | 5/1952 | Buttery | 229/28 R |
| 2,705,588 | 4/1955 | Huckstep | 229/42 X |
| 2,894,672 | 7/1959 | Bamburg | 229/27 |
| 3,014,632 | 12/1961 | Kuchenbecker | 229/15 |
| 3,236,433 | 2/1966 | Barrett et al. | 229/15 |
| 3,317,111 | 5/1967 | Black | 229/15 |

*Primary Examiner*—Davis T. Moorhead
*Attorney, Agent, or Firm*—Charles P. Bauer

[57] ABSTRACT

A cushion partition tray formed from a single piece blank cut, scored and slotted to form a bottom with panels framing the bottom, which panels can be cross folded and locked over the bottom into a partition tray with a center section surrounded by smaller sections, which small sections will serve as a cushion for the center section when the tray is inserted into a box.

6 Claims, 6 Drawing Figures

Fig. 3.
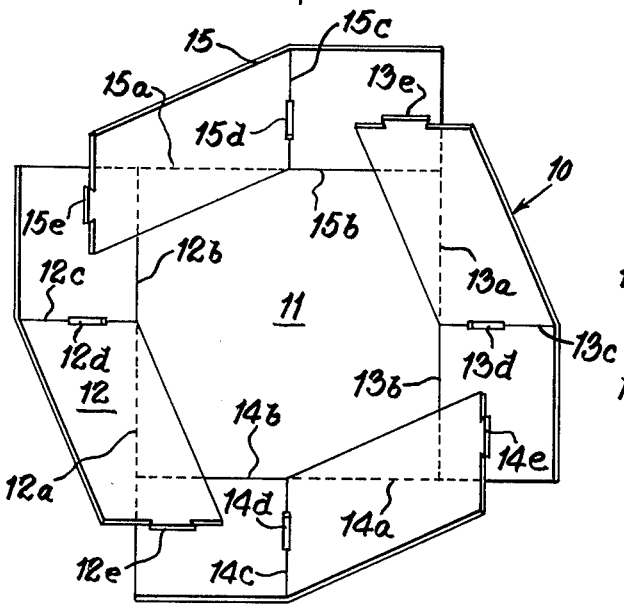
Fig. 4.
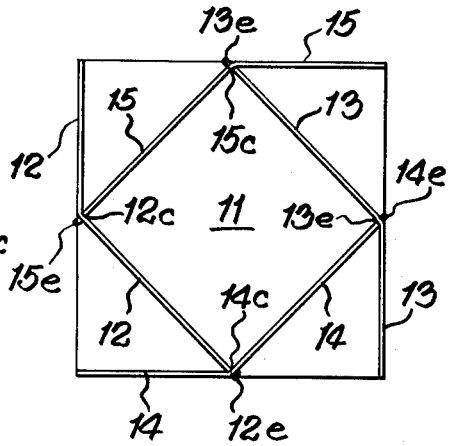
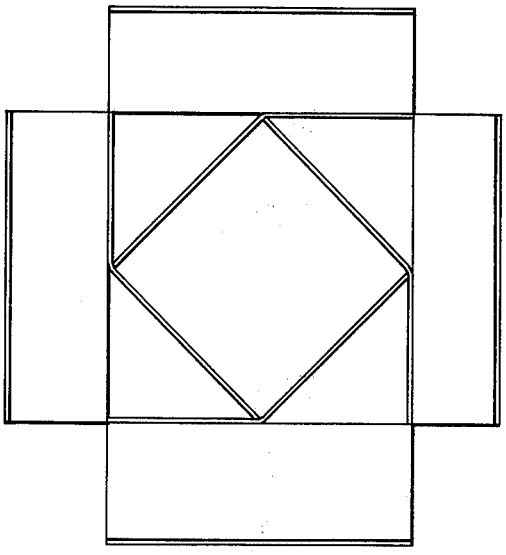
Fig. 5.
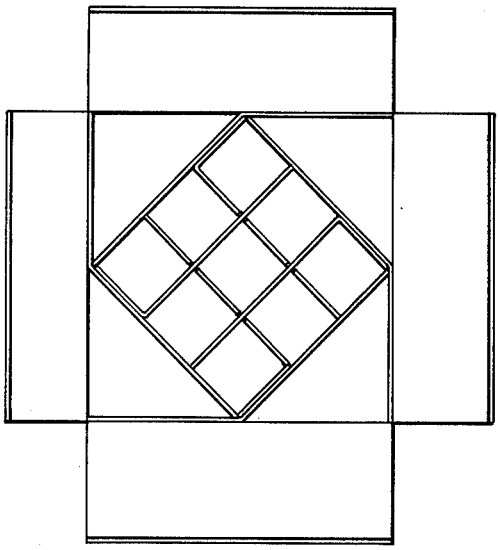
Fig. 6.

CUSHION PARTITION TRAY FOR INSERTION INTO A BOX

BACKGROUND OF THE INVENTION

This invention relates to an improvement in partition trays and more particularly to a tray made from a single piece blank which can be inserted into a box to provide a center section for receiving products for packing and shipping and smaller sections surrounding the center section and serving as a cushion for the products packed in the center section.

Most partition trays are formed by fitting together separate pieces to provide the desired sections or cells. The present invention seeks to simplify the formation of such tray by fabricating it from a single piece blank which can be set up to provide the section or cells.

SUMMARY OF THE INVENTION

It is an object of the invention to provide a partition tray suitable for insertion into a box for packing and shipping products in separate sections or cells.

It is a further object to provide a partition tray having a center section for packing products which section is surrounded by smaller sections to serve as a cushion for the products during shipment.

It is a further object to provide a partition tray which can be formed from a single piece blank.

It is a further object to provide a blank which is simple and economical to manufacture and can easily be set up into a partition tray which is efficient and well suited for its intended purpose.

BRIEF DESCRIPTION OF THE DRAWINGS

Other objects and advantages will become apparent from the following description which is to be taken in conjunction with the accompanying drawings, in which:

FIG. 3 is a top view of the blank showing the initial step in folding the partition panels into position;

FIG. 4 is a top view of the blank of FIG. 1 with all of the panels folded into position to complete the partition tray ready for insertion into a box;

FIG. 5 is a top view of a box with the completed partition tray inserted therein; and FIG. 6 is a top view of the tray and box of FIG. 5 with another cellular partition tray inserted into the center section of the tray of the present invention.

DESCRIPTION OF THE PREFERRED EMBODIMENT

Figure 1:
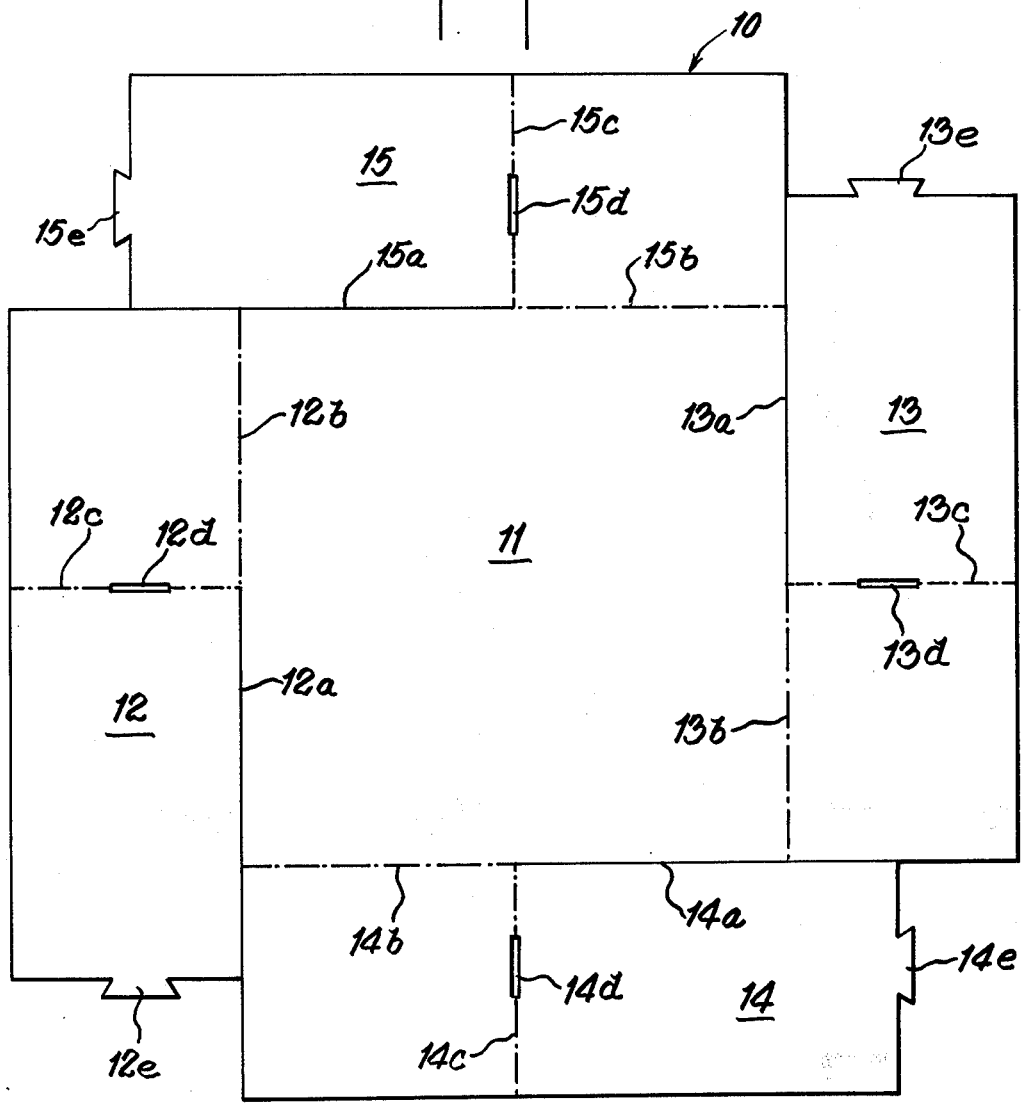
FIG. 1 is a plan view of a blank for the partition tray of the present invention.

Referring to the drawings, there is shown in FIG. 1 a flat blank, which generally square except for cut out corners, of sheet material such as corrugated board, fiberboard or the like, of a weight suitable for the type of tray to be constructed. The blank 10 consists of a bottom panel 11 framed by a series of panels 12, 13, 14 and 15 which, when the blank is set up, will form the walls of the sections or cells of the tray. The panel 12 is formed by cutting the blank along the line 12*a* and leaving the panel connected to the bottom panel 11 only along the hinge score line 12*b*. The cut line 12*a* and the hinge score line 12*b* each meet approximately half way down one side of the bottom panel. Such panel

12 has a hinge score line 12*c* normal to the hinge score line 12*b* at the point where the score line 12*b* and the cut line 12*a* meet. The score line 12*c* divides the panel into two wall portions which when the blank is set up into a tray will each form the side of a section of the tray. There is a slot 12*d* cut into the hinge score line 12*c* and a tapered tongue 12*e* cut out of the free end of the wall portion of panel 12 which is cut from the bottom panel. The tongue and slot are matching to form a lock when the tongue of one panel is inserted into the slot of another panel as hereinafter described. Similarly panels 13, 14 and 15 are cut, scored and slotted in the same manner and designated by the corresponding letters *a*, *b*, *c*, *d* and *e*.

Figure 2:
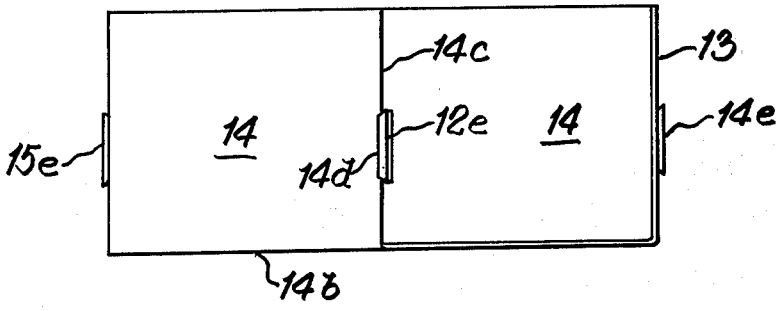
FIG. 2 is a side view of the tray set up from the blank of FIG. 1.

Referring to FIGS. 3 and 4, the blank is set up into a tray by folding each of the panels 12, 13, 14 and 15 along their hinge score lines b so that the panels are each at approximately a right angle to the bottom panel 11. Each panel is then folded along its hinge score line c across the bottom panel at an angle and the tongue e is inserted into the slot *d* of the adjacent panel, i.e., tongue 12*e* into slot 14*d* (FIG. 2), tongue 14*e* into slot 13*d*, tongue 13*e* into slot 15*d*, and tongue 15*e* into slot 12*d*. The panels are each of such length that the free portion of the panel will extend to the hinge score line *c* of the adjacent panel to permit the matching tongue and slot to be locked together. When all of the panels have been set up and their tongues interlocked with the slots of the adjacent panels, the completed tray will consist of a square center section surrounded four triangular sections (FIG. 4).

The center section of the completed tray is shown as generally being square in shape with the other four sections triangular and uniform in size. However, the lengths of the panels and positions of the hinge lines and slots can be varied to form sections which are rectangular or of other shape, depending on the shapes of the sections desired for the particular product to be packaged.

The completed partition tray can be inserted into a box to provide a center section suitable for packaging various products (FIG. 5). The triangular sections surrounding the center section will serve as a cushion to protect the products in the center section, or, where cushioning is not required, can be used for packaging other products of possibly different configuration. In my copending application Ser. No. 599,924, filed July 28, 1975, there is described and claimed a partition tray which is particularly adapted to fit into the center section of the tray of the present invention to provide cells to receive products.

Thus, among others, the several aforenoted objects and advantages are most effectively attained. Although a somewhat preferred embodiment of the invention has been disclosed and herein described in detail, it should be understood that this invention is in no sense limited thereby and its scope is to be determined by that of the appended claims.

Having thus described the invention, what is claimed is:

1. A one sheet blank adapted for folding into a partition tray having center section of rhomboid shape surrounded by smaller rectangular sections comprising:

a generally rectangular bottom panel; and four rectangular panels forming a frame around the said bottom panel, each of said rectangular panels having a. a width equal to the desired height of the sections;

b. a first hinge score line normal to the longitudinal edges of the said rectangular panel dividing the said panel into first and second portions;

c. a slot cut into the said first hinge score line;

d. the first portion thereof connected to a different but corresponding corner of the said bottom panel along a second hinge score line normal to the first hinge score line and extending from the said corner of the said bottom panel to the end of the first hinge score line adjacent the said bottom panel;

e. the said second portion thereof of such length that the free end thereof will extend when the said rectangular panels are folded upward and over the said bottom panel, to the adjacent first hinge score line of the adjacent rectangular panel; and f. a tongue on the said free end adapted and positioned to engage the said slot in said adjacent first hinge score line of the said adjacent rectangular panel and lock the said panels in position over the said bottom panel.

2. The blank of claim 1 wherein the bottom panel is generally square and the four rectangular panels are substantially the same length and have the same length first and second portions whereby the center section of the partition tray will be of square shape.

3. The blank of claim 2 wherein the first hinge score line of each rectangular panel is positioned at the center of a side of the center panel whereby the surrounding triangular sections are substantially the same size.

4. A partition tray having a center section of rhomboid shape surrounded by smaller triangular sections comprising:

a generally rectangular bottom panel; and four rectangular panels folded over the bottom panel to form the walls of the sections, each rectangular panel having:

a. a width equal to the height of the sections;

b. a first hinge score line normal to the longitudinal edges of the said rectangular panel dividing the said panel into first and second portions;

c. a slot cut into the said first hinge score line;

d. the first portion thereof connected to a different but corresponding corner of the said bottom panel along a second hinge score line normal to the first hinge score line and extending from the said corner of the said bottom panel to the end of the first hinge score line adjacent the said bottom panel;

e. the second portion thereof of such length that the free end thereof extends to the adjacent first hinge score line of the adjacent, rectangular panel; and f. a tongue on the said free end engaging the said slot in said adjacent first hinge score line of the said adjacent rectangular panel and locking the said panels in position over the said bottom panel.

5. The tray of claim 4 wherein the bottom panel is generally square and the four rectangular panels are substantially the same length and have the same length first and second portions whereby the center section of the partition tray will be of square shape.

6. The tray of claim 5 wherein the first hinge score line of each rectangular panel is positioned at the center of the side of the center panel whereby the surrounding triangular sections are substantially the same size.

* * * * *